US005860876A

United States Patent [19]

Rich Guffey

[11] Patent Number: 5,860,876

[45] Date of Patent: Jan. 19, 1999

[54] STAINED GLASS GOLF COURSE MARKERS

[76] Inventor: Shirley Joelene Rich Guffey, 821 Flint Ridge Dr., Kansas, Okla. 74347

[21] Appl. No.: 762,141

[22] Filed: Mar. 31, 1997

[51] Int. Cl.[6] ..... A63B 57/00

[52] U.S. Cl. ..... 473/405; 428/38

[58] Field of Search ..... 473/405, 131, 473/406, 409, 404; 428/38, 210; 52/311.1

[56] References Cited

U.S. PATENT DOCUMENTS

D. 353,208 12/1994 Kozak ..... D25/52

3,382,134 5/1968 Powell ..... 428/38

3,833,450 9/1974 Powell ..... 428/38

5,626,525 5/1997 Tolley et al. ..... 473/405

*Primary Examiner*—Steven B. Wong

[57] ABSTRACT

Stained glass Golf Course markers comprised of concrete and stained glass which show the layout of each hole on a golf course, including the hole number, Par, handicap, and tee to green yardage from each tee box. The concrete and glass construction provide a durable marker which will withstand exposure to the elements well. These markers are also very unique and beautiful and thus will add greatly to the appearance of any golf course.

1 Claim, 1 Drawing Sheet

STAINED GLASS GOLF COURSE MARKERS

BACKGROUND OF THE INVENTION

Stained glass golf course markers provide new, beautiful and very durable golf course tee box markers. These markers are made of stained glass and concrete and therefore are not affected by the elements (water, salt, sun and freezing temperatures will not affect the markers since they are as durable as any concrete product).

Golf Courses have used a marking system for many, many years to indicate the layout of the fairway as well as the tee to green yardage's, however this present invention of a marker made of concrete and stained glass is new and unique to the golf course industry, having several benefits and improvements. Unlike wooden markers which have to be repainted and/or replaced in a few years, these concrete and glass markers contain no paint and will remain beautiful for many, many years with no maintenance required. These stained glass and concrete golf course markers will greatly enhance the physical appearance of golf courses wishing to upgrade their marking system to one which will remain beautiful for many years with no maintenance required.

BRIEF SUMMARY OF THE INVENTION

This present invention is of a golf course tee box marker comprised of stained glass and concrete. These stained glass golf course markers are not only unique and beautiful, but are also very durable and functional. The concrete and glass will withstand the elements very well. The beautiful stained glass colors will not fade from sun exposure and will remain beautiful for many, many years, while requiring very little maintenance. Most markers available contain paint which will deteriorate and fade with exposure to sun, water and chemicals often used on golf courses and thus require significant maintenance.

Said markers serve a useful purpose in playing the game of golf by providing a graphic display of the fairway, green, sand traps, and other hazards. The yardage from each tee box to the green is illustrated also, as well as the Par for a particular hole on a course.

The present invention of stained glass and concrete tee box markers differ significantly from other tee box markers, not only in composition but also by providing golf courses desiring different, beautiful and unique markers an opportunity to upgrade the visual appeal of their course while also obtaining a very high quality marker which requires very little maintenance.

DETAILED DESCRIPTION OF THE INVENTION

Figure 1:
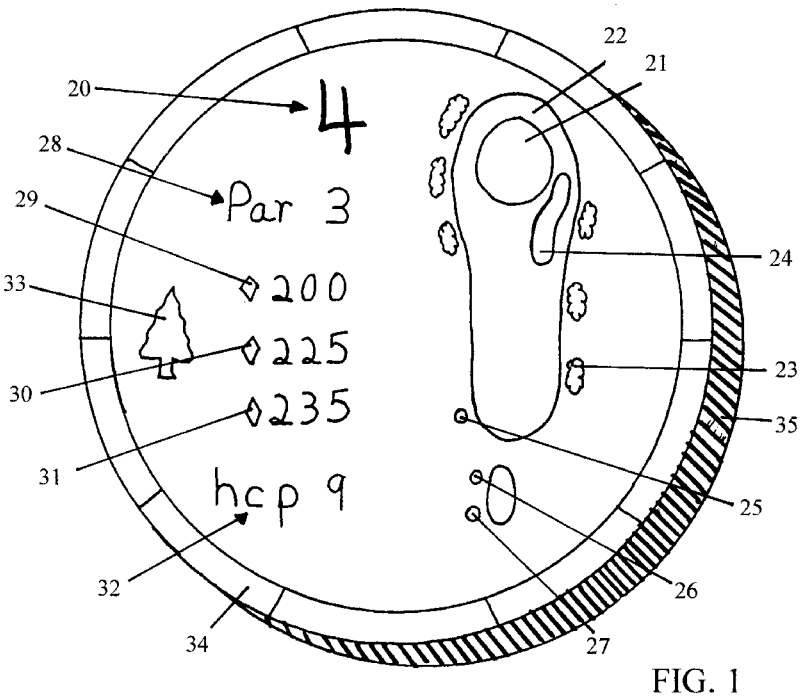
FIG. 1 is a round Tee Box Marker, used to show the hole number, handicap, Par, and the tee to green yardage's.

FIG. 1 illustrates a golf course tee box marker which is round in shape. Said marker is constructed of a mixture of portland cement and an aggregate. The aggregate may consist of sand, gravel, ground or pulverized stone, and gypsum. This concrete mixture is inlaid with stained glass which has been cut and ground to match a particular pattern of the graphic layout of a golf course hole. The number four (20) on the face of the marker indicates that this is the marker for the number four hole on a particular course. This number is stained glass which has been cut and ground to match the graphic design for the numeral four. The graphic layout of the green is illustrated at (21). The green is cut and ground out of a green glass that visually stands out from the fairway green. The graphic layout of the fairway is illustrated by (22). The fairway is composed of stained glass which has been cut and ground to match the graphic layout of the number four hole on a particular golf course. The location of trees is indicated by (23). These trees are cut from green stained glass in sizes and shapes which illustrate the location of a tree or a group of trees on a particular fairway. The sand trap (24) is cut and ground to match the graphic shape and location of the sand trap or traps on a particular fairway. The stained glass used for the sand traps is white or off-white in color. The location of the ladies tee box (25) is indicated by a small piece of red glass. The location of the men's tee box (26) is indicated by a small piece of white glass, while the expert tee box (27) is indicated by a small piece of black glass. The Par 3 (28) indicates that this particular hole requires that a golfer get his ball from the tee box to the hole in three strokes in order to achieve a Par for that particular hole. The letters and numerals are cut and ground stained glass. A small piece of red stained glass, illustrated at (29) is used to indicate that the distance from the ladies tee box to the green is 200 yards. The 225 is marked by a small piece of white glass to indicate that the distance from the men's tee box to the green is 225 yards (30). A small piece of black glass (31) is used to mark the 235 which indicates the yardage from the expert tee box to the green. The hcp 9 (32) indicates that the number four hole on this golf course is the ninth most difficult hole on the course. The arrowhead (33) is used to illustrate a sample of a course's particular logo. Other examples of logo's may include names, animals, trees, ect. For example, a course named Panther's Run may have a panther as it's logo, Willowbrook may have a willow tree, Cherry Springs may have a cluster of cherries, or the logo may consist of the course's name such as Flint Ridge. A stained glass border is illustrated at (34). This will be in a color desired by a particular course. Each course will have color preferences for all stained glass contained within a said marker. A course may have specific colors which they desire to mark their tee boxes. (35) indicates the depth of said marker from front to back. This depth being 1 ¾" to 2".

Figure 2:
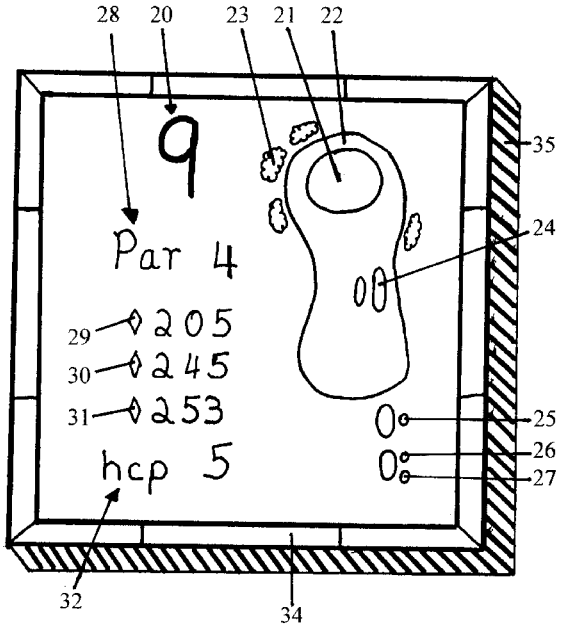
FIG. 2 is a square Tee Box Marker, used to show the hole number, handicap, Par, and the tee to green yardage's.

FIG. 2 shows a tee box marker with an alternate shape. While the marker in FIG. 2 is square, I have also made a rectangular marker constructed according to the teachings of the present invention. The number nine (20) indicates that this is the marker for the number nine hole on a particular course. This number is stained glass which has been cut and ground to match the graphic design of the numeral nine. The graphic layout of the fairway is illustrated at (22). The fairway is composed of stained glass which has been cut and ground to illustrate the layout of the fairway on the number nine hole of a particular golf course. (23) illustrates the location of trees. These trees are cut in sizes and shapes to match the location of a tree or a group of trees on a particular fairway or adjacent to the fairway. The location of sand traps on a particular fairway are illustrated by (24). The location of the ladies tee box (25) is indicated by a small piece of red glass. The location of the men's tee box (26) is indicated by a small piece of white glass. The expert tee box (27) is indicated by a piece of black glass. The Par 4 (28) illustrates that this number nine hole requires that a golfer get his ball from the tee box to the hole in four strokes in order to achieve a Par. All letters and numerals consist of accurately cut and ground glass. A small piece of red glass (29) is used to indicate that the distance from the ladies tee to the green is 205 yards, whereas white glass (30) is used to indicate a yardage of 245 yards from the men's tee to the green. A piece of black glass (31) is used to indicate a distance of 253 yards from the expert tee box to the green. The hcp 5 (32) indicates that this number nine hole is the fifth most difficult hole on the course. The glass border is indicated by (34). The depth (35) of said marker from front to back is 1 ¾" to 2".

Figure 3:
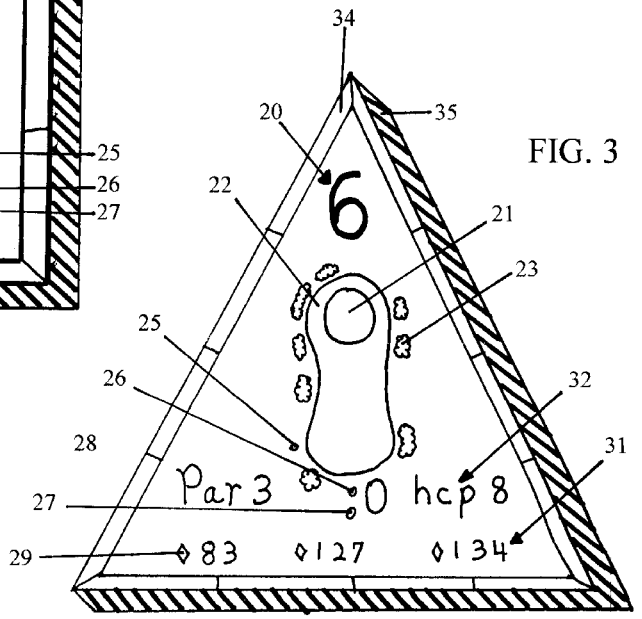
FIG. 3 is a triangular shaped Tee Box Marker, used to show the hole number, Par, handicap and tee to green yardage's.

FIG. 3 illustrates a triangular shaped marker constructed according to the teachings of the present invention. The number six (20) indicates a marker for the number six hole on a particular golf course. This number consists of stained glass which has been cut and ground to match the graphic design of the numeral six. The graphic layout of the fairway (22) is composed of stained glass which has been cut and ground to match the graphic layout of the fairway on the number six hole of a particular golf course. The location of a tree is indicated by (23). As previously mentioned, the location and quantity of trees will match the actual trees on or adjacent to a particular fairway. The ladies tee box location (25) is marked by a piece of red glass, while the men's tee box (26) is marked by white glass and the expert tee box is indicated by a piece of black glass. While these markers illustrate only three tee boxes, many courses contain up to five tee boxes which will all require a different color of glass for marking the location of each individual tee box. The Par 3 illustrated by (28) conveys that this particular hole requires a golfer to get his ball from the tee box to the green in three strokes in order to achieve a Par for the hole. The hcp 8 (32) indicates that this number six hole is the eighth most difficult hole on the course. Again, all letters and numbers consist of accurately cut and ground stain glass. A small piece of red glass (29) is used to indicate that the distance from the ladies tee box to the green is 83 yards, while white glass (30) indicates the yardage distance from the men's tee box to the green is 127 yards. The yardage of the expert tee box (31) is marked by a small piece of black glass. A stained glass border is indicated by (34). The front to back depth of said marker is indicated by (35) and is 1 ¾" to 2".

The first step in making a stained glass marker is to sketch the layout of the hole. A pattern is then made and transferred to the glass. The glass is cut and ground to match the pattern. The glass is then positioned in the bottom of a mold. The mold used for FIG. 1 is round and twenty-five inches in diameter with a depth of two inches, however, different sizes and shapes of molds may be used, without departing from the teachings of the present invention. Next, sifted concrete is poured over the glass to a depth of one-half to three-fourths inch. Re-enforcing wire is added next and then the form is filled with concrete. After the concrete has set, the marker is removed from the mold and the exposed glass is cleaned. When the concrete marker has completely cured, it is sealed with a concrete sealer on the top and sides.

Although the present invention of stained glass and concrete golf course markers has been described in detail, it should be understood that various changes, modifications, substitutions and alterations may be made without departing from the scope of the present invention which is solely defined by the following claim.

What is claimed is:

1. A golf course tee box marker comprising:

a backing composed of cement and an aggregate having a depth of 1.75 to 2 inches; a stained glass front surface displaying a graphic design of a particular golf hole, said stained glass being cut and ground to display the graphic layout of the hole including fairway, green, sand traps, trees and hazards and numerals indicating the number of the hole and the yardage from each tee box to a hole, said front surface also containing tee to green yardage distances which are color coded to match the colors of the tee boxes thus indicating the location of each tee box and the yardage to the green from that particular tee box, said front surface also containing a stained glass border and a stained glass logo as desired by a particular golf course;

wherein the golf course marker serves as a useful distance guide for the game of golf.

* * * * *